US008222583B2

(12) United States Patent
Fu et al.

(10) Patent No.: US 8,222,583 B2
(45) Date of Patent: Jul. 17, 2012

(54) DRAG-STABILIZED WATER-ENTRY PROJECTILE AND CARTRIDGE ASSEMBLY

(75) Inventors: Jyun-Horng Fu, Centreville, VA (US); Antonio Paulic, Arlington, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 442 days.

(21) Appl. No.: 12/409,265

(22) Filed: Mar. 23, 2009

(65) Prior Publication Data

US 2010/0237186 A1 Sep. 23, 2010

(51) Int. Cl.
*F42B 15/22* (2006.01)

(52) U.S. Cl. ..... 244/3.25; 102/390; 102/398

(58) Field of Classification Search ..... 102/399, 102/390, 351, 398; 114/20.1; 244/3.25
See application file for complete search history.

(56) References Cited

U.S. PATENT DOCUMENTS

| | | | | | |
|---|---|---|---|---|---|
| 1,384,841 | A | | 7/1921 | Lundell | |
| 2,103,155 | A | | 12/1937 | Foulke | |
| 2,401,853 | A | * | 6/1946 | Bailey | 244/3.25 |
| 2,597,703 | A | * | 5/1952 | Busacker | 244/3.25 |
| 2,654,320 | A | * | 10/1953 | Schmid | 244/138 A |
| 2,656,135 | A | * | 10/1953 | Barker et al. | 244/87 |
| 2,835,199 | A | * | 5/1958 | Stanly | 244/3.25 |
| 2,937,824 | A | * | 5/1960 | Krumbholz et al. | 244/3.25 |
| 2,992,794 | A | * | 7/1961 | Boyd | 244/3.15 |
| 3,041,992 | A | | 7/1962 | Lee | |
| 3,088,403 | A | * | 5/1963 | Bartling et al. | 102/399 |
| 3,141,409 | A | * | 7/1964 | Travis et al. | 102/399 |
| 3,282,216 | A | | 11/1966 | Calfee et al. | |
| 3,391,885 | A | * | 7/1968 | Genco | 206/521 |
| 3,434,425 | A | | 3/1969 | Critcher | |
| 3,568,956 | A | | 3/1971 | Swanson | |
| 3,613,617 | A | * | 10/1971 | Hamilton | 114/20.1 |
| 3,636,877 | A | * | 1/1972 | Eaton, Jr. | 102/378 |
| 3,713,387 | A | * | 1/1973 | Karp | 102/387 |
| 3,727,569 | A | * | 4/1973 | Johnson et al. | 114/20.1 |
| 3,867,893 | A | * | 2/1975 | Saholt et al. | 114/20.1 |
| 3,915,092 | A | | 10/1975 | Monson et al. | |
| 4,145,017 | A | * | 3/1979 | Stiklorus | 244/3.25 |
| 4,296,894 | A | * | 10/1981 | Schnabele et al. | 244/3.27 |
| 4,497,460 | A | * | 2/1985 | Thorsted et al. | 244/3.3 |
| 4,674,706 | A | | 6/1987 | Hall | |
| 4,844,380 | A | * | 7/1989 | Peoples et al. | 244/3.22 |
| 5,014,931 | A | * | 5/1991 | Mikhail | 244/3.25 |
| 5,150,858 | A | * | 9/1992 | Hopwell et al. | 244/45 A |
| 5,760,330 | A | | 6/1998 | Himmert et al. | |
| 5,929,370 | A | | 7/1999 | Brown et al. | |
| 5,955,698 | A | | 9/1999 | Harkins et al. | |
| H1938 | H | | 2/2001 | Harkins et al. | |
| 6,405,653 | B1 | | 6/2002 | Miskelly | |
| 6,540,175 | B1 | | 4/2003 | Mayersack et al. | |

(Continued)

*Primary Examiner* — Benjamin P Lee
(74) *Attorney, Agent, or Firm* — Howard IP Law Group, PC

(57) ABSTRACT

A drag-stabilized water-entry projectile having a projectile body, one or more drag-stabilizing elements, such as fins, flares or canards, and one or more attachment members adapted to hold the one or more drag-stabilizing elements to the projectile body. The one or more attachment members are coated with a thermally reactive material. A projectile and cartridge assembly has a shear pin, a projectile having a first cutout portion, the cutout portion sized to receive the shear pin. The assembly also includes a sabot configured to house the projectile and having a second cutout portion, the second cutout portion sized to receive the shear pin. The cutout portion is positioned to provide an offset region between an aft end of the projectile and a base of the sabot.

8 Claims, 13 Drawing Sheets

U.S. PATENT DOCUMENTS 6,540,176 B2 * 4/2003 Davis et al. ..... 244/3.24
6,548,794 B2 * 4/2003 Facciano et al. ..... 244/3.1
6,601,517 B1 8/2003 Guirguis
6,684,801 B1 2/2004 Kuklinski
6,739,266 B1 5/2004 Castano et al.
6,865,523 B2 3/2005 Varghese et al.
7,118,072 B2 10/2006 Kobayashi et al.
7,156,032 B2 1/2007 Kornblit et al.
7,343,860 B2 3/2008 Michel et al.
7,347,146 B1 3/2008 Gieseke
7,415,930 B2 8/2008 Raphelt et al.
7,709,772 B1 * 5/2010 Patel et al. ..... 244/3.25
7,779,759 B2 8/2010 Paulic et al.
7,800,032 B1 * 9/2010 Facciano et al. ..... 244/3.24
7,829,829 B2 * 11/2010 King et al. ..... 244/3.25
7,880,125 B1 * 2/2011 Patel et al. ..... 244/3.25
2003/0019978 A1 1/2003 Varghese et al.
2004/0107826 A1 6/2004 Simmons
2007/0077044 A1 4/2007 Kirschner et al.
2010/0031841 A1 2/2010 Michel et al.
2010/0219285 A1 * 9/2010 Facciano et al. ..... 244/3.25

* cited by examiner

DRAG-STABILIZED WATER-ENTRY PROJECTILE AND CARTRIDGE ASSEMBLY

FIELD OF THE INVENTION

The present invention relates generally to munitions, and particularly to drag-stabilized munitions used in air-to-sea applications.

BACKGROUND

Projectiles having fins or similar drag-stabilizing features are known to exhibit good aerodynamic stability but poor cavity-running stability upon water-entry. Drag-stabilizing features of such projectiles such as fins, flares or canards are known to be responsible for causing instability during water entry, particularly at low grazing-angles, and ultimately cause the self-destruction of the projectile. Improvements to drag-stabilized water-entry projectiles are thus desired.

DETAILED DESCRIPTION

Reference will now be made in detail to the present exemplary embodiments of the invention, examples of which are illustrated in the accompanying drawings.

Figure 1:
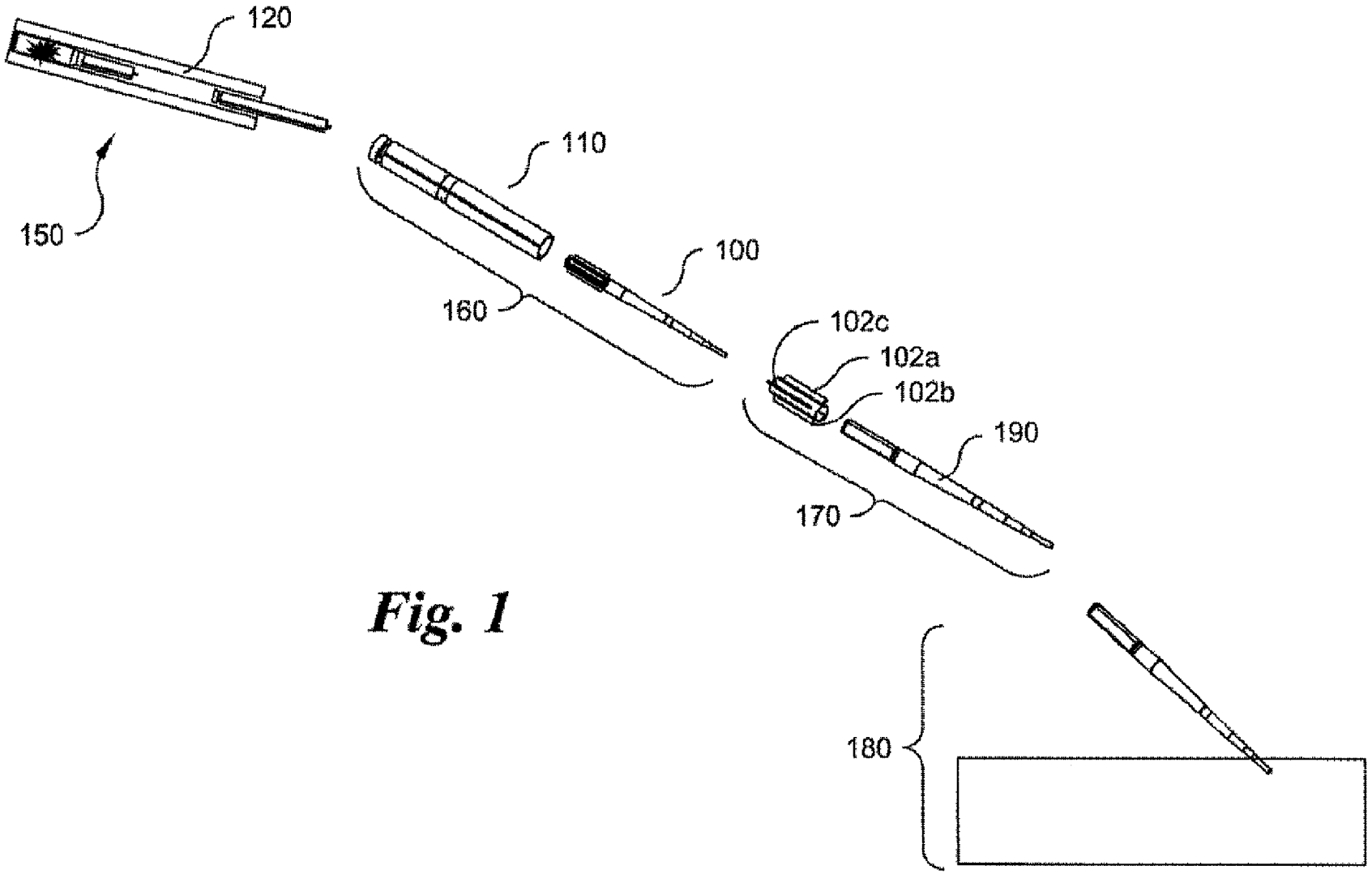
FIG. 1 is a diagram illustrating a firing sequence of a projectile in accordance with an exemplary embodiment of the invention.

Referring to FIG. 1, a diagram is shown illustrating the firing sequence of a projectile 100 in accordance with an exemplary embodiment of the invention. The projectile 100 is initially housed within a sabot 110 and is located within an artillery barrel 120. At a first stage 150, the projectile and sabot assembly is fired from the barrel 120. After exiting the barrel, the sabot 110, which at a forward end is divided into three separate components by three longitudinal slits, will slow in velocity relative to the projectile 100 and petal away from the projectile. This is illustrated at the sabot and projectile separation stage labeled as 160 in FIG. 1. The projectile 100 further comprises a set of drag-resisting elements such as fins 102*a*, 102*b* and 102*c*. After the sabot and projectile have separated, the projectile will travel through air until reaching fin separation stage 170 at which point the fins 102*a*, 102*b* and 102*c* will detach from the projectile body. After the fin separation stage 170 the projectile 100 will continue through air for a time less than the elapsed time in which the projectile with fins attached travels in air (and preferably a minimal time) until entering the water at water-entry stage 180. The illustrated projectile 100 at the water entry stage will subsequently enter water without fins and hence will not experience the destabilizing effects that would have occurred if the fins 102*a*, 102*b* and 102*c* had not detached prior to water entry. The projectile 100 will then supercavitate through the fluid (e.g. water) until reaching a target destination.

Figure 2A:
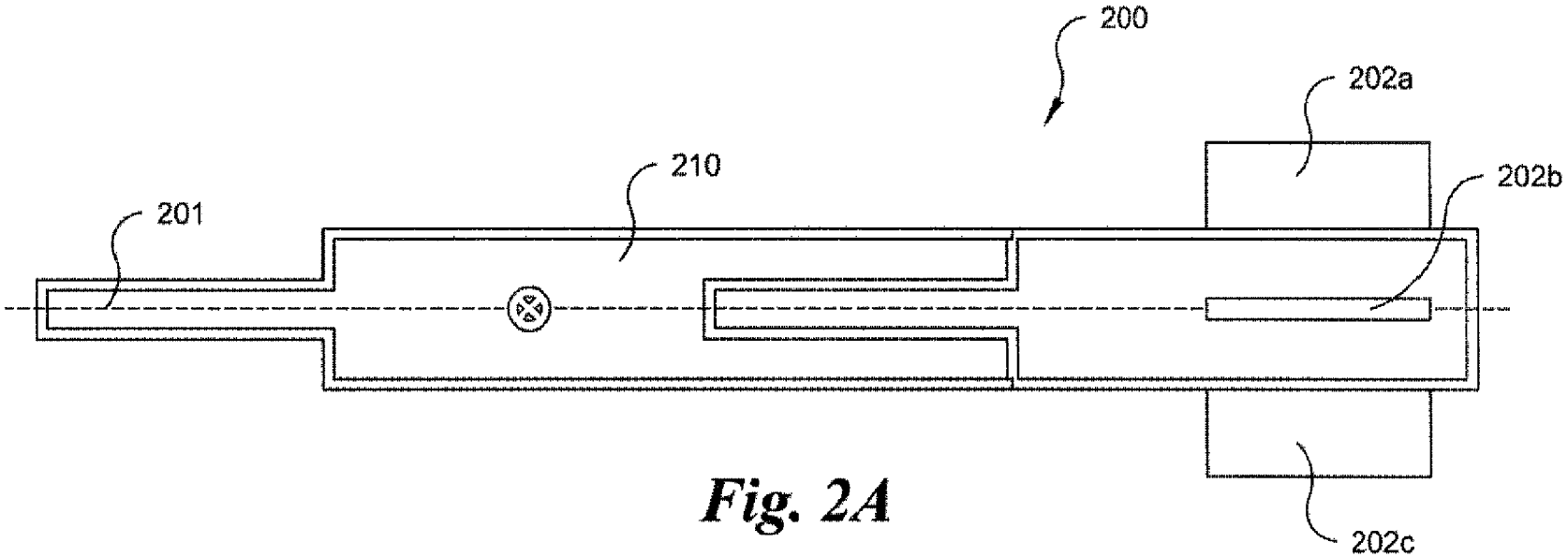
FIG. 2A is a diagram illustrating a schematic section view of a projectile in accordance with an exemplary embodiment of the invention.
Figure 2B:
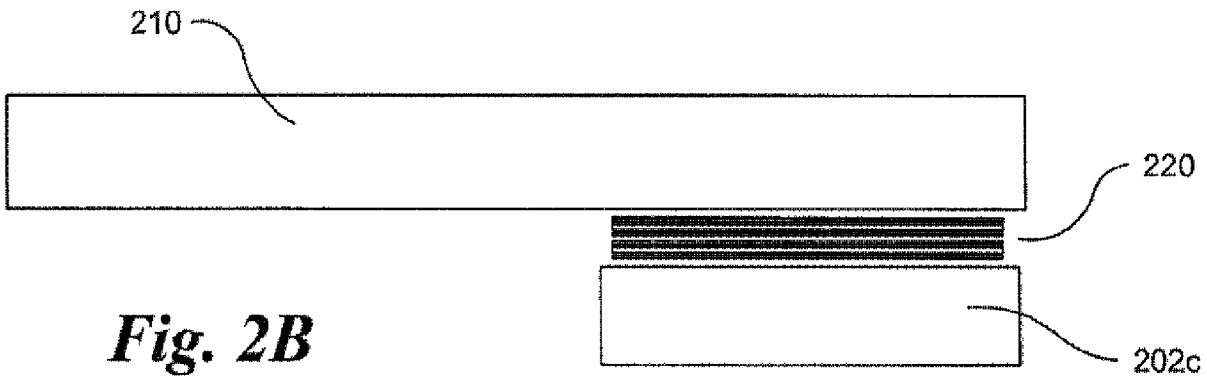
FIG. 2B is a diagram illustrating a schematic section view of a projectile in accordance with the exemplary projectile of FIG. 2B.

Referring now to FIGS. 2*a* and 2*b*, schematic section views of a projectile 200 in accordance with an exemplary embodiment of the invention are shown. The projectile 200 has a generally cylindrical body 210, substantially symmetrical in rotation about an axis 201. The projectile further comprises three drag-stabilizing features shown, by way of example only, as fins 202*a*, 202*b* and 202*c*. It is noted that the drag-stabilizing features may take the form of fins, flares, canards or other type of drag-stabilizing feature, by way of example only, enhancing the aerodynamic stability of the projectile. The projectile 200 further comprises at least one coupling member 220 for attaching each of the fins 202*a*, 202*b* and 202*c* to the body 210 of the projectile. By way of example only, the coupling member 220 may attach the fins 202*a*, 202*b* and 202*c* to the projectile 200 by thermal, electromagnetic, chemical or mechanical means. Each type of coupling mechanism acts only to provide temporary coupling of the fins to the body of the projectile 200 thereby allowing the fins to detach from the body during flight. In one exemplary embodiment a thermal coupling mechanism utilizes heat applied to the mechanism to cause separation of the fins from the body. In another exemplary embodiment, an electromagnetic coupling mechanism utilizes a reversal of polarity to allow the fins to separate from the body. In still another exemplary embodiment, a chemical coupling mechanism initiates a chemical reaction to allow the fins to separate from the body.

In yet another exemplary embodiment, a mechanical coupling mechanism, which may take the form of a weak structural linkage or a loosely attached linkage, relies on resistive forces (e.g. wind resistance) during projectile flight, to cause the fins to separate or slide away from the body of the projectile 200.

Figure 3:
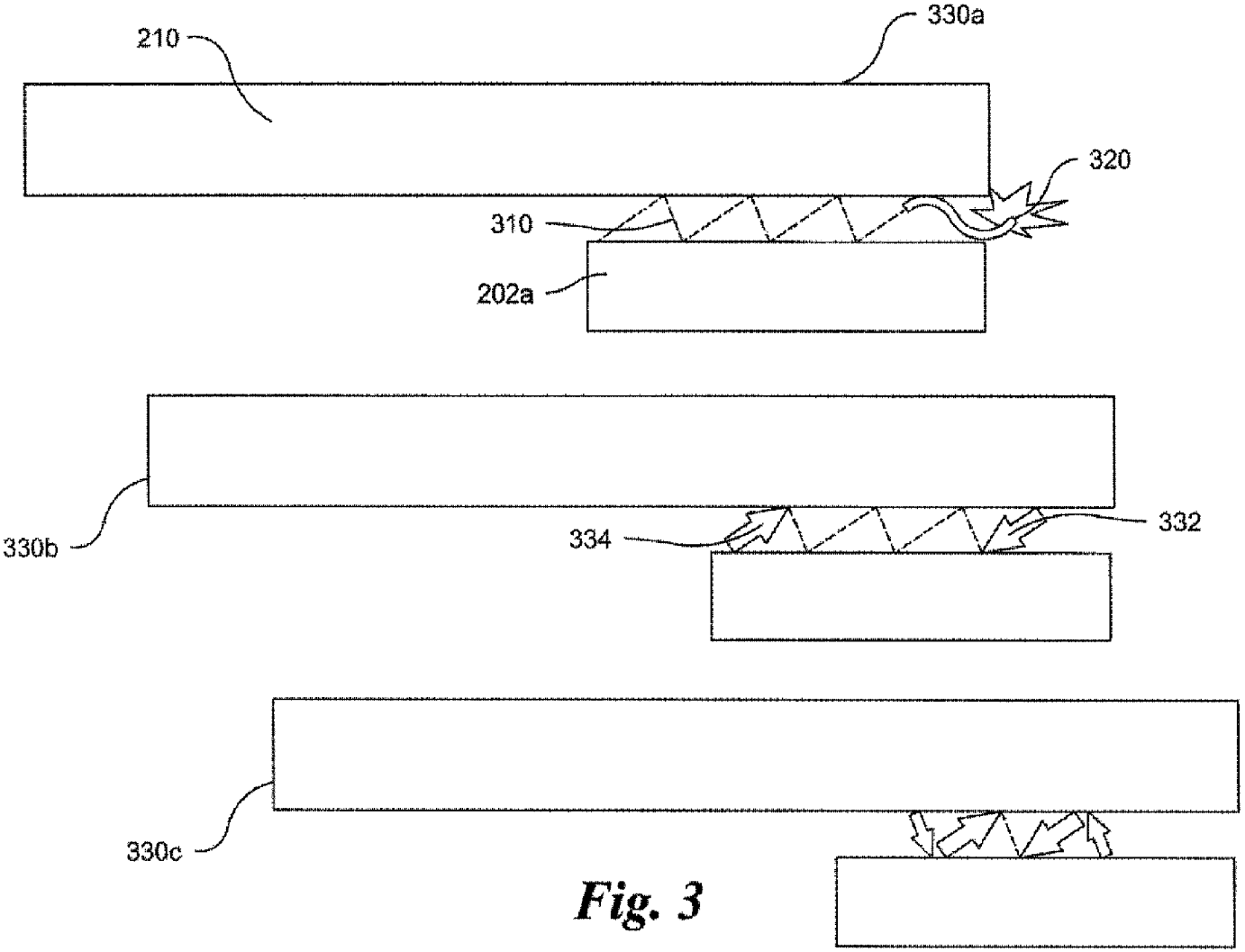
FIG. 3 is a diagram illustrating a side view of a projectile in accordance with another exemplary embodiment of the invention.

Referring now to FIG. 3, a diagram is shown illustrating a side view of the projectile 200 of FIG. 2 in accordance with an exemplary thermal coupling embodiment of the invention. The projectile 200 of FIG. 3 includes a thermal mechanism 310 for attaching the fins 202*a*, 202*b* and 202*c* to the body 210 of the projectile 200. The exemplary embodiment also includes a fuse 320, ignition of which may be triggered during the firing of the projectile, at which point the projectile 200 is still located within the artillery barrel, FIG. 3 shows the projectile 200 at three stages labeled 330*a*, 330*b* and 330*c*. At the first stage 330*a* the fuse 320 has been recently ignited. At stage 330*b* a portion of the thermal coupling member 310 has begun to burn off as indicated by the arrows 332 and 334 showing the direction of burn. Stage 330*c* shows the projectile in a state just prior to detachment, where most of the thermal coupling member 310 has been incinerated.

Figure 4A:
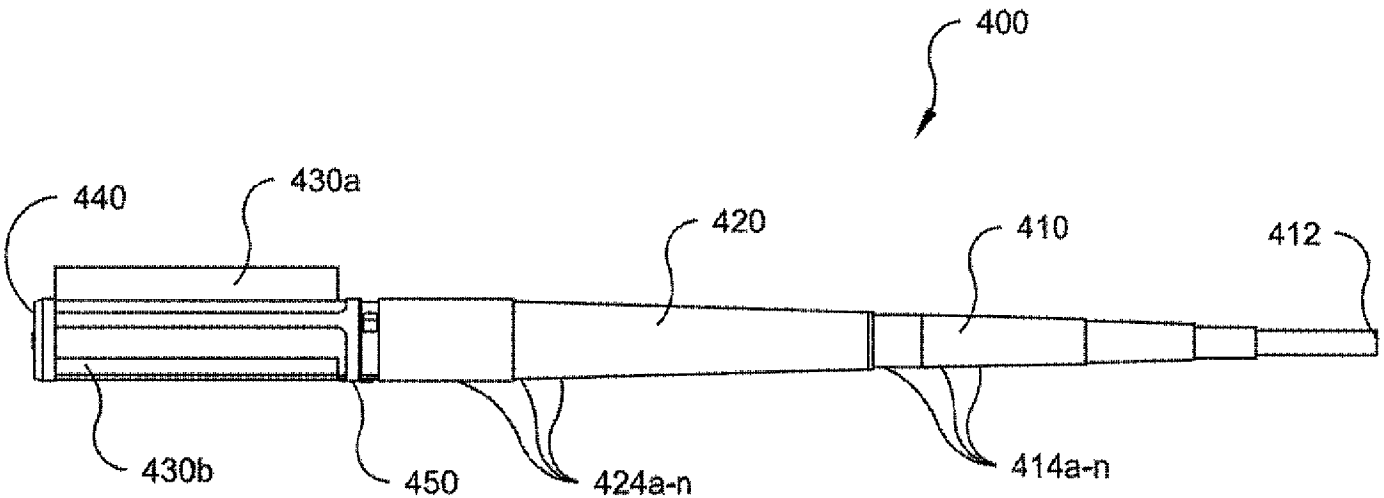
FIG. 4A is a diagram illustrating a side view of a projectile in accordance with another exemplary embodiment of the invention.
Figure 4B:
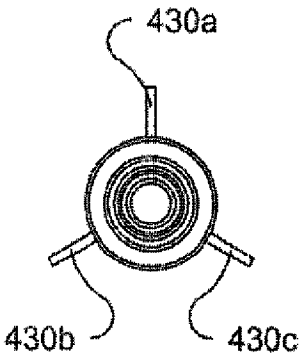
FIG. 4B is a diagram illustrating an end view of a projectile in accordance with the exemplary projectile of FIG. 4A.

Referring now to FIGS. 4A and 4B, diagrams are shown illustrating a side view and an end view of a projectile 400 in accordance with another exemplary embodiment of the invention. The projectile 400 comprises a nose section 410 having a flat forward end 412 and a series of stepped sections 414*a-n* for improving the supercavitating stability of the projectile. The projectile 400 further comprises a body 420 having an aft end 440 and another series of stepped sections 424*a-n*. By way of example only, the projectile may be a .50 caliber round having an overall length of approximately eight inches (e.g. approximately 20.3 cm) and a range of approximately 500 feet (e.g. approximately 152 meters). The projectile further comprises, three drag-stabilizing features shown, by way of example only, as fins 430*a*, 430*b* and 430*c* (not shown). It is noted that the drag-stabilizing features may take the form of fins, flares, canards or other type of drag-stabilizing feature, by way of example only, enhancing the aerodynamic stability of the projectile. The projectile 400 comprises an attachment mechanism 450 for coupling each of the fins 430*a*, 430*b* and 430*c* to the body 420 of the projectile 400. The attachment mechanism 450 may include a thermally reactive material which will cause the attachment mechanism 450 to disintegrate in a controlled manner after ignition. This controlled burn of the attachment mechanism will result in detachment of the fins 430*a*, 430*b* and 430*c* at a controlled point in time. By way of example only, the thermally reactive material may be a thermally reactive foil or thin film and may be applied by soldering. The segmented fins are made of a material (e.g. aluminum) sufficiently compatible for attachment via the foil using solder. In a preferred embodiment, the thermally reactive material is a reactive nano-foil material developed by Reactive NanoTechnologies (RNT). However, other such thermally reactive materials and applications for detaching the drag-stabilizing members from the body of the projectile just prior to water entry of the projectile are contemplated.

Figure 5:
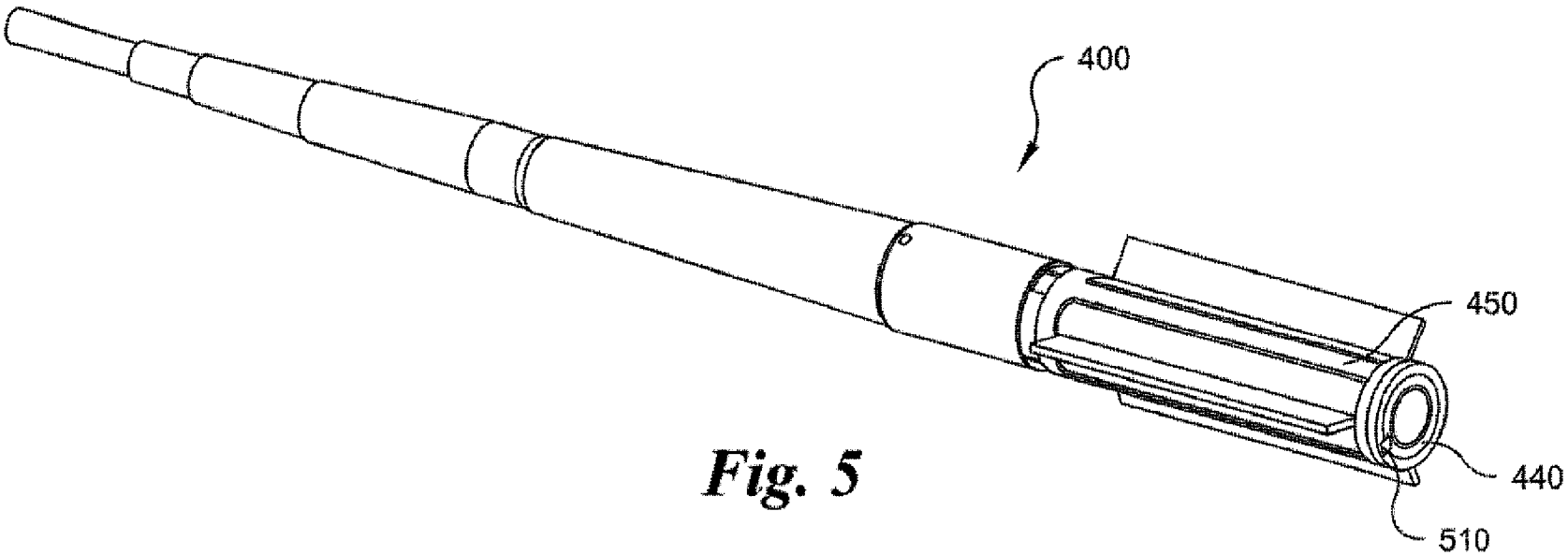
FIG. 5 is a diagram illustrating an isometric view of the exemplary projectile of FIG. 4A.

Referring now to FIG. 5, an isometric view of the exemplary projectile 400 of FIG. 4A is shown. At the aft end 440 of the projectile 400 a tabbed portion 510 of the attachment mechanism 450 is shown extending over the aft end of the projectile. The tabbed portion 510 of the attachment mechanism 450 is adapted to trigger ignition of the attachment mechanism upon receipt of a kinetic impact. The tabbed portion 510 may be comprised of a similar reactive nano-foil material (or a different material) having sufficient sensitivity to trigger ignition of the attachment mechanism upon receipt of a kinetic impact.

Figure 6:
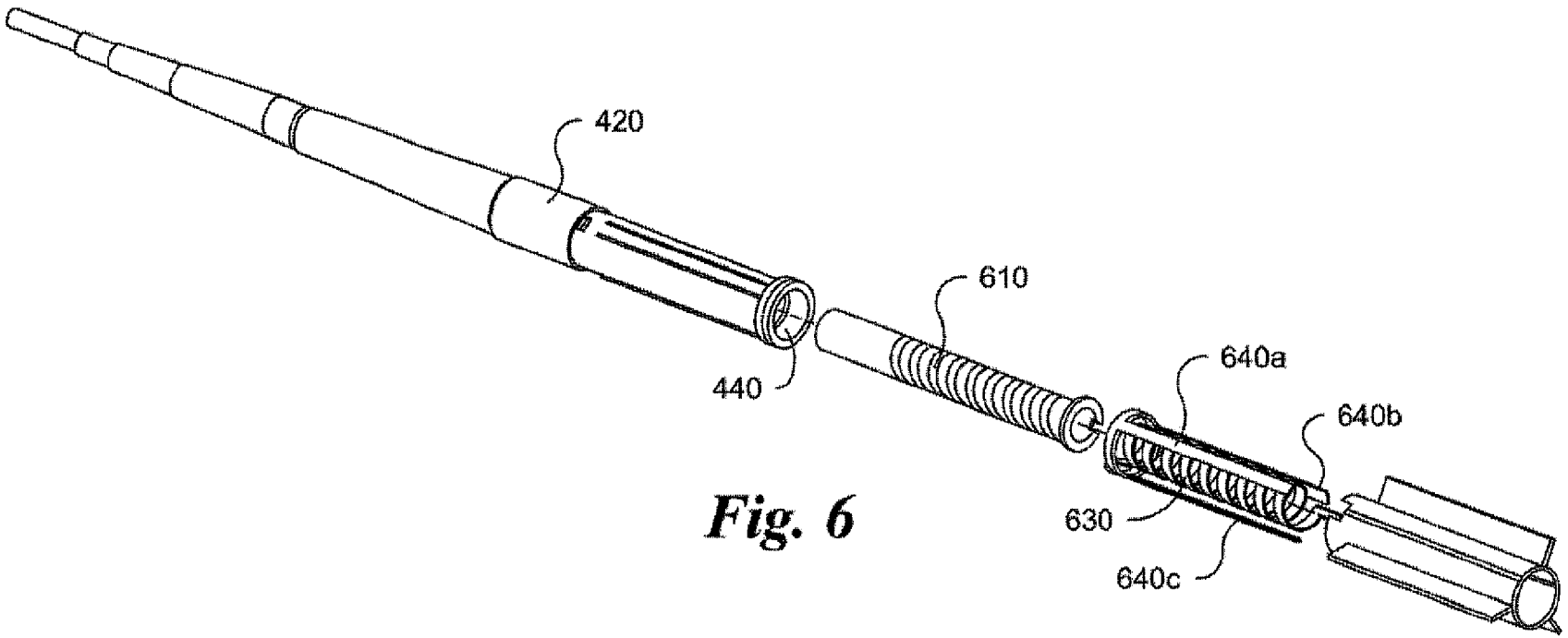
FIG. 6 is a diagram illustrating an exploded view of the exemplary projectile of FIG. 4A.

Referring now to FIG. 6, an exploded view of the exemplary projectile 400 of FIG. 4A is shown. As shown, the projectile 400 also comprises a mandrel 610 which is inserted into the aft end 440 of the body 420 of the projectile 400. The attachment mechanism 450 of the projectile further comprises a coiled section 630 and three elongated sections 640*a*, 640*b* and 640*c*. The coiled section 630 of the attachment mechanism 450 is first wrapped around the mandrel 610 and together these elements are inserted into the body 420 of the projectile. Elongated sections 640*a*, 640*b* and 640*c* of the attachment mechanism 450 are coupled to the coiled section after the mandrel 610 has been inserted into the projectile body. Coupling of the coiled section 630 to the elongated sections 640*a*, 640*b* and 640*c* may be carried out, for example, by soldering the components together. It is to be understood that a monolithic integrated or multiple component structure may be utilized in view of the embodiment as described herein.

Figure 7B:
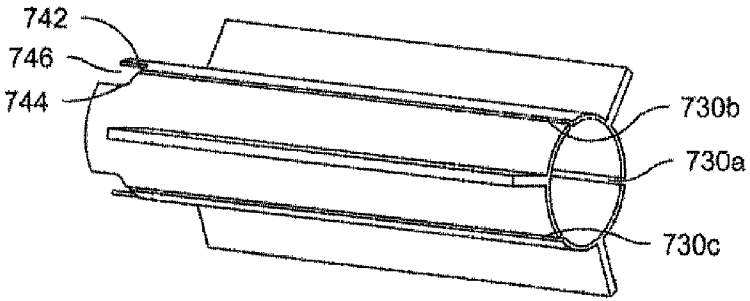
FIG. 7B is a diagram illustrating an isometric view of the fins of the exemplary projectile of FIG. 4A.
Figure 7A:
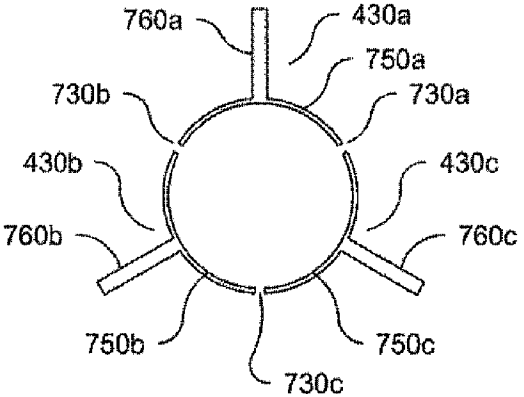
FIG. 7A is a diagram illustrating an end view of a set of fins in accordance with the exemplary projectile of FIG. 4A.

Referring now to FIG. 7A, an end view of the segmented fins 430*a*, 430*b* and 430*c* of the projectile 400 of FIG. 4A is shown. Each of the segmented fins 430*a*, 430*b* and 430*c* has a curved base section labeled as 750*a*, 750*b* and 750*c* respectively. The curved base sections 750*a*, 750*b* and 750*c* are shaped to mate to the cylindrical exterior of the body 420 of the projectile 400. Each of the segment fins 430*a*, 430*b* and 430*c* further comprises a radial protrusion, labeled as 760*a*, 760*b* and 760*c* respectively, that protrudes radially outward from the curved base section enhancing the aerodynamic stability of the projectile. As shown in FIG. 7A, there exists a gap between each of the segmented fins 430*a*, 430*b* and 430*c* forming three seams labeled as 730*a*, 730*b* and 730*c*. The seams 730*a*, 730*b* and 730*c* allow the segmented fins 430*a*, 430*b* and 430*c* to detach or break away from the projectile 400 during flight.

Referring now to FIG. 7B, an isometric view of the segmented fins 430*a*, 430*b* and 430*c* of the projectile 400 of FIG. 4A is shown. As shown, the forward end of one or more of the segmented fins 430*a*, 430*b* and 430*c* comprises cutout sections 742 and 744, sized to form a gap 746.

Figure 7C:
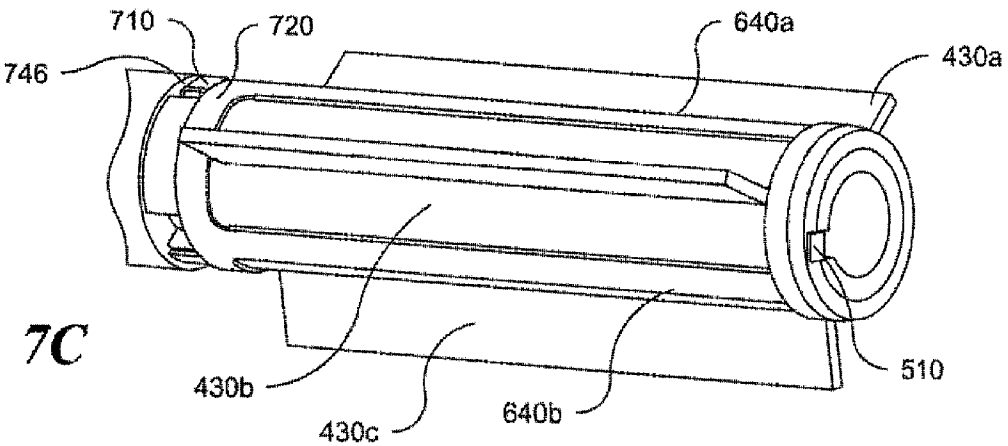
FIG. 7C is a diagram illustrating an isometric view of an aft section of the exemplary projectile of FIG. 4A.

Referring now to FIG. 7C, an isometric view of an aft section of the projectile 400 of FIG. 4A is shown. The elongated sections 640*a*, 640*b* and 640*c* (not shown) of the attachment mechanism 450 are disposed around the exterior of the fins 430*a*, 430*b* and 430*c* while the coiled section 630 (not shown) of the attachment mechanism 450 is located interior to the fins 430*a*, 430*b* and 430*c* and the body 420 of the projectile 400. The attachment mechanism 450 further comprises an extension element 710 that extends from a forward end of the coiled section 630. As shown the extension element 710 extends through the body 420 of the projectile 400 and the gap 746 formed by segment fins 430*a*, 430*b* and 430*c* to attach to an exterior circular band 720 of the attachment mechanism 450. Each of the three elongated sections 640*a*, 640*b* and 640*c* extend in a direction aftward from the circular band section 720. Each of the elongated sections 640*a*, 640*b* and 640*c* may be soldered to the segmented fins 430*a*, 430*b* and 430*c* of the projectile at or near each of the seams 730*a*, 730*b* and 730*c* as shown in FIG. 7A. By soldering the elongated sections 640*a*, 640*b* and 640*c* of the attachment mechanism 450 to the segmented fins near the seams 730*a*, 730*b* and 730*c* the fins will then be allowed to break away or detach from the projectile when the attachment mechanism 450 disintegrates during flight.

Figure 8A:
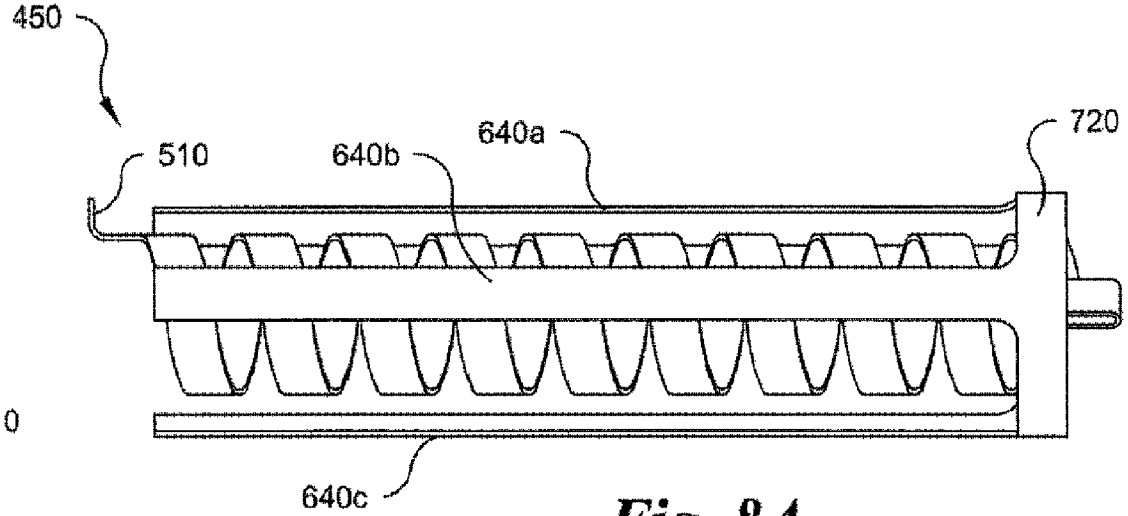
FIG. 8A is a diagram illustrating a side view of a delay mechanism of the exemplary projectile of FIG. 4A.
Figure 8B:
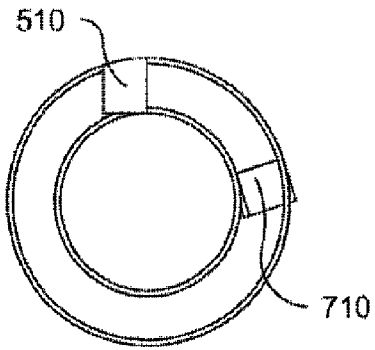
FIG. 8B is a diagram illustrating an end view of the delay mechanism of the exemplary projectile of FIG. 4A.
Figure 8C:
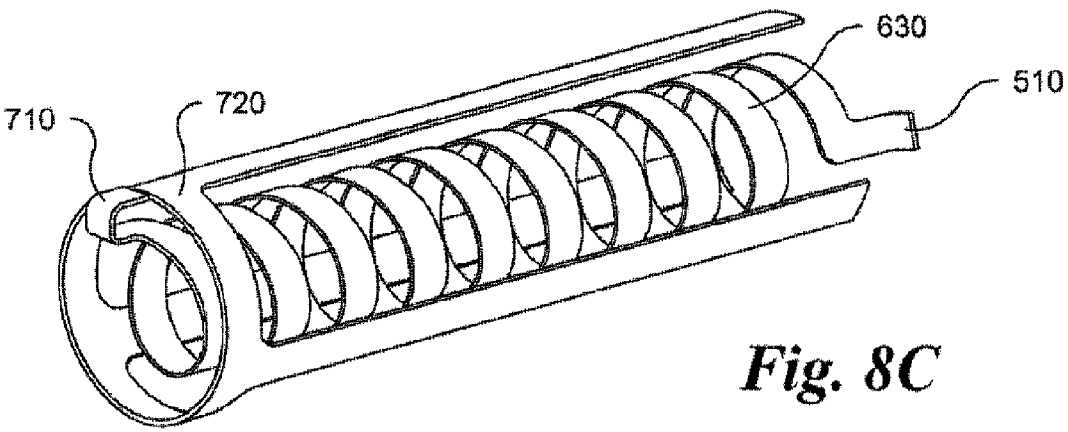
FIG. 8C is a diagram illustrating an isometric view of the delay mechanism of the exemplary projectile of FIG. 4A.

Referring now to FIGS. 8A, 8B and 8C, a side view, an end view and an isometric view of the attachment mechanism 450 of the exemplary projectile of FIG. 4A are shown. The attachment mechanism 450 includes the tabbed portion 510 that extends over an aft end of the projectile 400. The tabbed portion 510 is coupled to the coiled section 630 which extends from the aft end to the forward end of the attachment mechanism 450. At the forward end of the attachment mechanism 450 the coiled section 630 connects to the extension element 710 of the attachment mechanism 450. The extension element 710 then connects to the exterior circular band 720 of the attachment mechanism 450. The attachment mechanism further comprises the three elongated sections 640*a*, 640*b* and 640*c* that extend in a direction aftward from the circular band section 720. The connections between each section of the attachment mechanism may be formed, for example, by soldering the components together. It is understood that a monolithic integrated or multiple component structure may be utilized in view of the embodiment as described herein. The tabbed portion 510 that extends over the aft end of the projectile 400 may also include an impact sensitive material that facilitates ignition of the attachment mechanism 450 upon receipt of a kinetic impact. After the impact sensitive tabbed portion 510 is triggered, the coiled section 630 will ignite, followed by extension section 710, circular band section 720 and finally the elongated sections 640*a*, 640*b* and 640*c*. In this manner the coiled section 630 acts as a delay mechanism with the length of the coiled section directly affecting the time duration of the delay, similar in functionality to a fuse. One or more sections of the attachment mechanism 450 including the coiled section 630, the extension section 710, the circular band section 720 and the elongated sections 640*a*, 640*b* and 640*c* may also include a thermally reactive material for enhancing the incendiary property of the attachment mechanism. The thermally reactive material may be a reactive nanocoating material applied to the attachment mechanism 450 by sputter-coating.

Figure 9B:
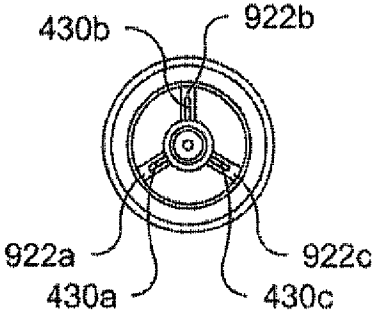
FIG. 9B is a diagram illustrating an end view of the projectile and cartridge assembly of FIG. 9A.
Figure 9A:
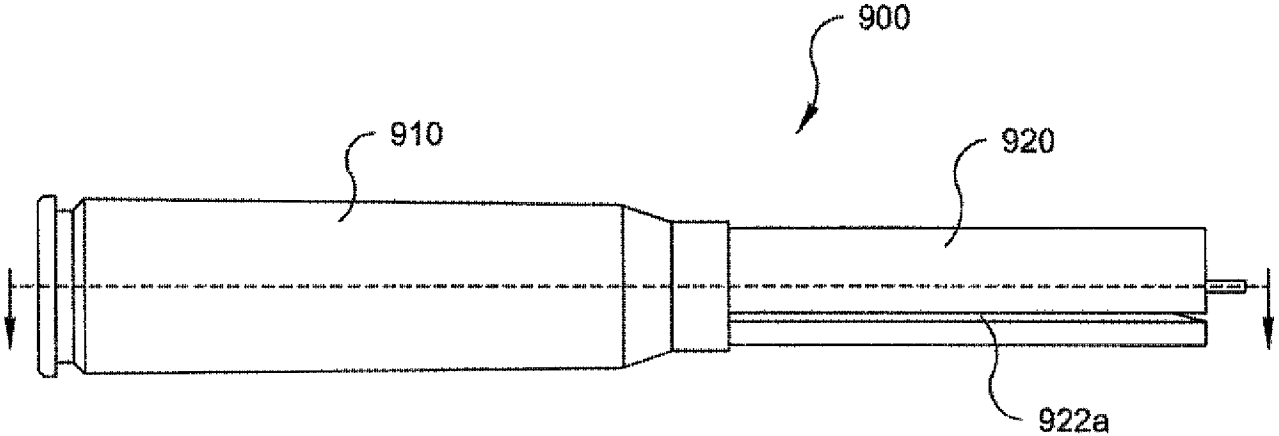
FIG. 9A is a diagram illustrating a side view of a projectile and cartridge assembly in accordance with an exemplary embodiment of the invention.

Referring now to FIGS. 9A and 9B, an isometric view and an end view of an exemplary cartridge assembly 900 for use with the projectile 400 of FIG. 4A is shown in accordance with an embodiment of the invention. The cartridge assembly 900 comprises a cartridge 910 which partially houses a sabot 920. The sabot 920 has three seams 922*a*, 922*b* and 922*c* running aftward from a forward end of the sabot. The seams 922*a*, 922*b* and 922*c* are sized to receive the fins 430*a*, 430*b* and 430*c* of the projectile 400. The seams 922*a*, 922*b* and 922*c* are of sufficient length to allow the projectile to be housed substantially within the sabot 920 and to allow the sabot to petal away from the projectile 400 during flight after exiting the artillery barrel.

Figure 9C:
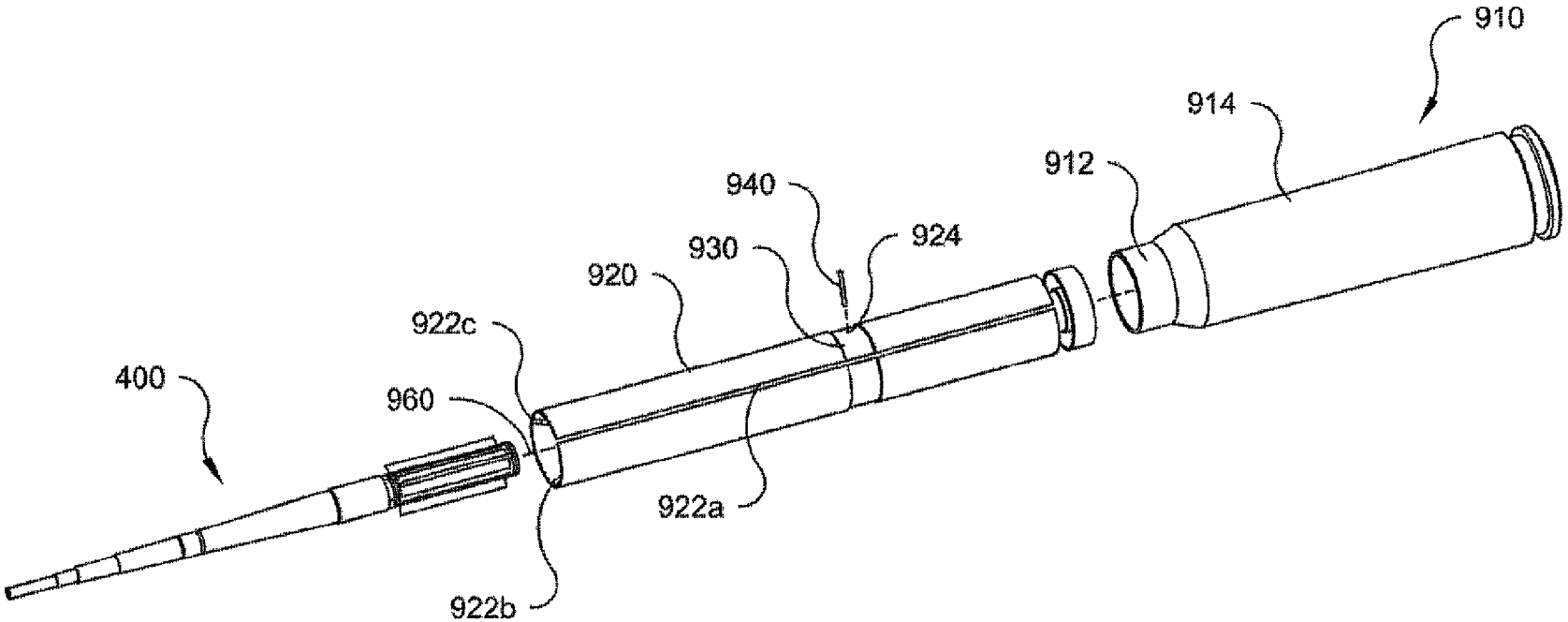
FIG. 9C is a diagram illustrating an exploded view of the projectile and cartridge assembly of FIG. 9A.

Referring now to FIG. 9C, an exploded view of the exemplary cartridge assembly of FIG. 9A is shown. As shown, the sabot 920 has a generally cylindrical body, substantially symmetrical about an axis 960. By way of example only the sabot has an outer diameter of 30 mm. The sabot 920 also has a single cylindrical cutout 924 located normal to the surface of section 930 and sized to receive a shear pin 940. The function of shear pin 940 will be discussed in detail below. The sabot 920 has a hollow center having an interior surface contoured to house the body of projectile 400. The sabot 920 has an exterior surface contoured as shown to allow the sabot 920 to be housed within the cartridge 910. As previously discussed, the sabot 920 has three seams 922*a*, 922*b* and 922*c* running aftward from a forward end of the sabot. These seams allow the sabot to petal away from the projectile 400 after exiting the artillery barrel. The cartridge 910 has a generally cylindrical body, substantially symmetrical about axis 960. The cartridge 910 includes a crimp section 912 located at the forward end of the cartridge as well as a larger diameter section 914 located aft of crimp section 912. The crimp section 912 is sized to mate with section 930 of the sabot 920 allowing the shear pin 940 to be held securely in place. By way of non-limiting example only, the cartridge 910 may be comprised of brass. The sabot 920 may be comprised of acrylic (plexiglass) and the shear pin 940 may be comprised of steel.

Figure 10A:
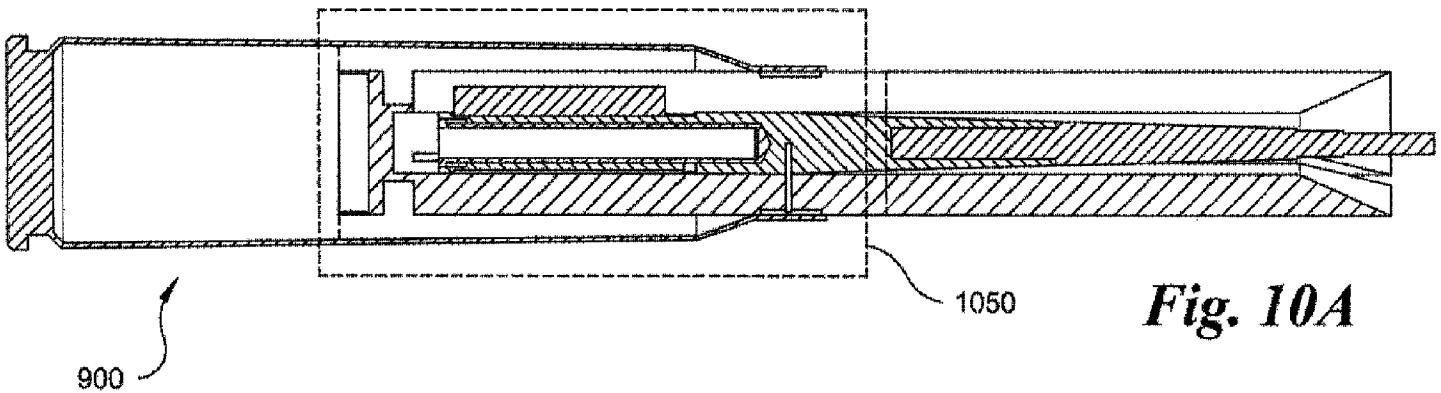
FIG. 10A is a diagram illustrating a section view of the exemplary projectile and cartridge assembly of FIG. 9A.
Figure 10B:
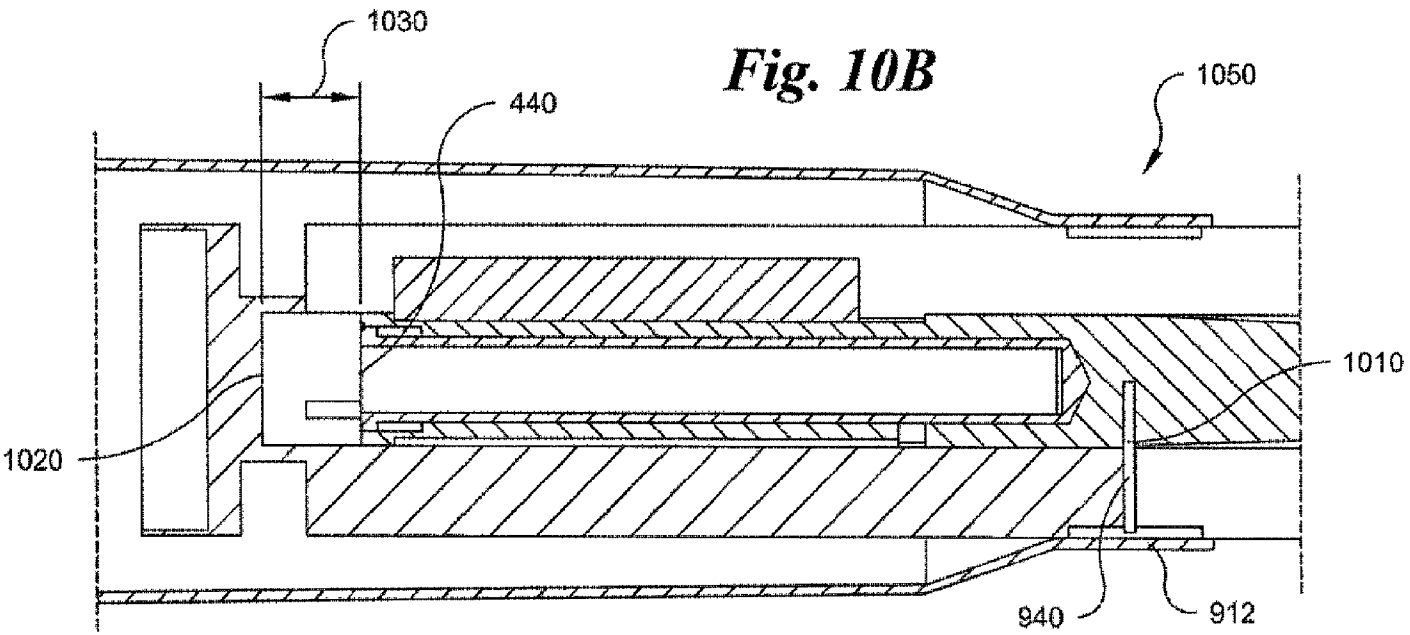
FIG. 10B is a diagram illustrating another section view of the exemplary projectile and cartridge assembly of FIG. 9A.

Referring now to FIGS. 10A and 10B, two section views of the exemplary cartridge assembly of FIG. 9A are shown. FIG. 10B shows an enlarged view of section 1050 of FIG. 10A. As previously discussed, the cartridge assembly 900 includes a shear pin 940, which extends through section 930 of the sabot 920 and inserts into the projectile 400 at insertion point 1010. The shear pin 940 may be 0.20 inch (e.g. approximately 0.51 cm) in diameter by 0.60 inches (e.g. approximately 1.52 cm) in length. The shear pin 940 is held in place by the crimp section 912 of the cartridge 910. As shown in FIG. 10B, the location of the shear pin insertion point 1010 on the projectile 400 is determined so that an offset 1030 between the aft end 440 of the projectile and the base of the sabot 1020 is established. By way of example only, the offset 1030 is shown in FIG. 10B to be 0.375 inches (e.g. approximately 0.95 cm). The attachment mechanism 450 includes tabbed portion 510 that extends over the aft end of the projectile and may be coated with an impact sensitive material that facilitates ignition of the attachment mechanism 450 upon receipt of a kinetic impact. The offset 1030 established by way of shear pin 940 is responsible for enabling this kinetic impact to occur, operation of which will now be discussed.

Figure 11:
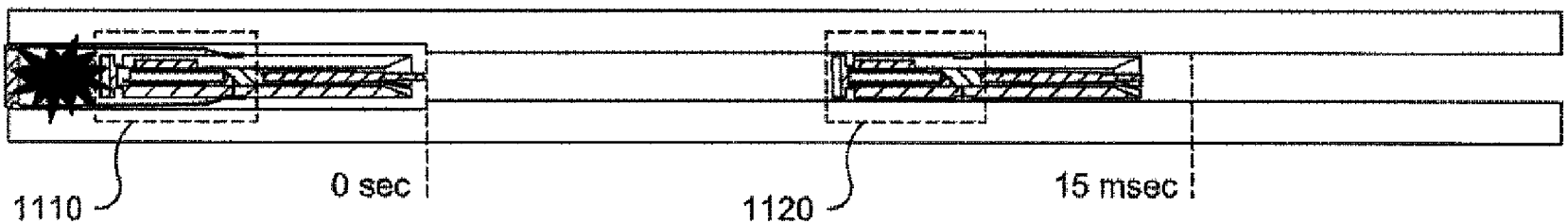
FIG. 11 is a diagram illustrating an exemplary firing sequence in accordance with the exemplary projectile and cartridge assembly of FIG. 9A.

Referring now to FIG. 11, a diagram illustrating an exemplary firing sequence in accordance with the exemplary cartridge assembly of FIG. 9A is shown. At a first stage labeled 1110, a propellant is ignited within cartridge 910 propelling the sabot 920 forward. At a second stage labeled 1120, the cartridge assembly 900 is also shown at a second point in time after ignition of the propellant has occurred. By way of example only this second point time is approximately 15 msec.

Figure 12A:
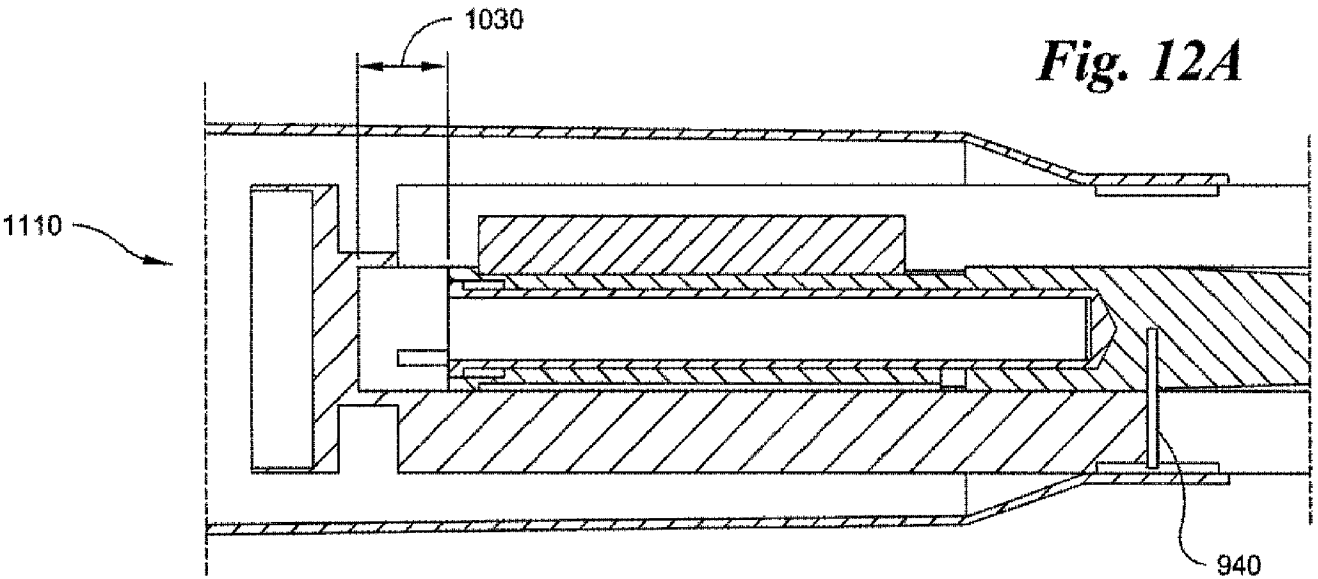
FIG. 12A is a diagram illustrating a section view of the exemplary projectile and cartridge assembly of FIG. 9A prior to a delay ignition.

Referring now to FIG. 12A, a snapshot of the cartridge assembly 900 is shown at the first stage 1110 (as shown in FIG. 11) immediately following ignition of the propellant. At this point in time the shear pin 940 is intact and the offset 1030 between the projectile and the sabot base has not changed from its original position.

Figure 12B:
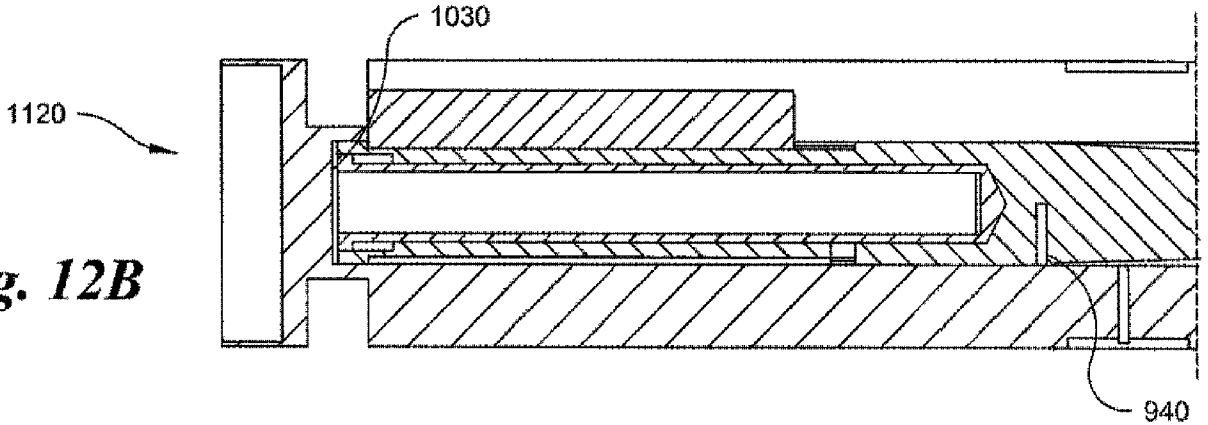
FIG. 12B is a diagram illustrating a section view of the exemplary projectile and cartridge assembly of FIG. 9A after delay ignition.

Referring now to FIG. 12B, a snapshot of the cartridge assembly 900 is shown during the second stage 1120 (as shown in FIG. 11). At this point in time the sabot 920 and projectile 400 have been ejected from the cartridge 910. Between stage 1110 and stage 1120 the difference in inertial acceleration experienced by the sabot 920 and the projectile 400 will cause the shear pin 940 to be defeated. Once the shear pin has been defeated the projectile 400 will slide aftward relative to the sabot 920. This relative motion reduces the offset 1030 between the aft end 440 of the projectile and the base 1020 of the sabot 920 until, as shown in FIG. 12B, the aft end of projectile 400 impacts the base 1030 of the sabot 920. The tabbed section 510 that extends over the aft end 440 of the projectile will thus receive a kinetic impact sufficient to ignite the impact sensitive coating of the tabbed section. Ignition of the coiled delay 630 will ensue followed by the remaining portions of the attachment mechanism 450 until the attachment mechanism has disintegrated enough to allow resistive forces (e.g. wind resistance) to shear fins 430*a*, 430*b* and 430*c* from the projectile 400.

Thus, a projectile having the benefits of drag-stabilized travel through air as well as stable entry into water has been described by means of example and not limitation. A projectile is contemplated having drag-stabilizing features such as fins, flares or canards along with an attachment mechanism that allows the drag-stabilizing features to be released from the projectile prior to water entry. Releasing the drag-stabilized features improves stability of the projectile upon water entry, particularly at low grazing angles. A cartridge assembly is also contemplated for operation with the projectile, the assembly having a mechanism for facilitating release of the drag-stabilizing features.

While the foregoing invention has been described with reference to the above-described embodiments, various modifications and changes can be made without departing from the spirit of the invention. Accordingly, all such modifications and changes are considered to be within the scope of the appended claims.

What is claimed is:

1. A water-entry projectile comprising:

a body;

one or more drag-stabilizing elements;

one or more attachment members adapted to couple said one or more drag-stabilizing elements to said body via a corresponding curved base which conforms circumferentially to an outer surface of said body, and said drag-stabilizing elements being disposed about an aft end of said body;

wherein said one or more attachment members are adapted to cause said one or more drag-stabilizing elements to detach from said projectile during air-borne flight prior to water entry;

an impact sensitive element, said impact sensitive element connected to one or more of said one or more attachment members and extending over a portion of said aft end of said projectile;

a delay element, said delay element connecting one or more of said one or more attachment members to said impact sensitive element;

wherein said impact sensitive element is adapted to ignite said delay upon receipt of a kinetic impact; and a coil extending through a center of said projectile, said coil coated with a thermally reactive material.

2. The projectile of claim 1, wherein each of said one or more drag-stabilizing elements comprises a fin extending radially from an outer surface of the body.

3. The projectile of claim 1, wherein said one or more attachment members comprise one or more longitudinal members coated with a thermally reactive material.

4. A projectile comprising:

a body;

one or more drag-stabilizing elements;

a means for attaching said plurality of drag-stabilizing elements to said body via a corresponding curved base which conforms circumferentially to an outer surface of said body, and said drag-stabilizing elements being disposed about an aft end of said body in such a way as to cause said drag-stabilizing elements to detach during flight;

wherein, the means for attaching said plurality of drag-stabilizing elements comprises:

a chemical bonding agent; and a delay mechanism coupled to said chemical bonding agent, said delay mechanism adapted to initiate a chemical reaction during firing of said projectile to cause said chemical bonding agent to deteriorate during flight.

5. The projectile of claim 4, wherein each of said one or more drag-stabilizing elements comprises a fin extending radially from an outer surface of the body.

6. The projectile of claim 4, wherein the means for attaching said plurality of drag-stabilizing elements further comprises:

one or more grooves cut into one or more sides of said projectile, said grooves extending to an aft end of said projectile and configured to mate with said one or more drag-stabilizing features;

wherein said one or more grooves are sized to allow said one or more drag-stabilizing features to slide off said projectile due to wind resistance.

7. A projectile comprising:

a body;

one or more drag-stabilizing elements;

a means for attaching said plurality of drag-stabilizing elements to said body via a corresponding curved base which conforms circumferentially to an outer surface of said body, and said drag-stabilizing elements being disposed about an aft end of said body in such a way as to cause said drag-stabilizing elements to detach during flight;

wherein the means for attaching said plurality of drag-stabilizing elements comprises:

an electromagnetic coupling mechanism;

a delay mechanism coupled to said electromagnetic coupling mechanism, said delay mechanism adapted to initiate a polarity reversal of said electromagnet coupling mechanism to cause said drag-stabilizing elements to detach during flight.

8. A water-entry projectile comprising:

a body;

one or more drag-stabilizing elements;

one or more attachment members adapted to couple said one or more drag-stabilizing elements to said body;

an impact sensitive element;

a delay element connecting one or more of said one or more attachment members to an impact sensitive element, said delay element comprising a coil extending through a center of said projectile, said coil coated with a thermally reactive material;

wherein said one or more attachment members are adapted to cause said one or more drag-stabilizing elements to detach from said projectile during air-borne flight prior to water entry; and wherein said impact sensitive element is connected to one or more of said one or more attachment members and extending over a portion of an aft end of said projectile; wherein said impact sensitive element is adapted to ignite said delay element upon receipt of a kinetic impact.

* * * * *